US007019662B2

(12) United States Patent
Shackle

(10) Patent No.: US 7,019,662 B2
(45) Date of Patent: Mar. 28, 2006

(54) LED DRIVE FOR GENERATING CONSTANT LIGHT OUTPUT

(75) Inventor: Peter W. Shackle, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 163 days.

(21) Appl. No.: 10/629,389

(22) Filed: Jul. 29, 2003

(65) Prior Publication Data

US 2005/0023536 A1 Feb. 3, 2005

(51) Int. Cl.
*G08B 5/22* (2006.01)
*G09F 9/33* (2006.01)

(52) U.S. Cl. ..... 340/815.45; 315/159

(58) Field of Classification Search ..... 340/815.45; 315/149, 156, 157, 158, 159
See application file for complete search history.

(56) References Cited

U.S. PATENT DOCUMENTS 4,001,667 A 1/1977 Bober
5,493,183 A * 2/1996 Kimball ..... 315/308
5,783,909 A * 7/1998 Hochstein ..... 315/159
5,912,568 A 6/1999 Kiley
6,226,539 B1 5/2001 Potratz
6,236,331 B1 * 5/2001 Dussureault ..... 340/815.45
6,628,252 B1 9/2003 Hoshino et al.
6,667,623 B1 * 12/2003 Bourgault et al. ..... 324/414
6,717,526 B1 * 4/2004 Martineau et al. ..... 340/815.45
6,798,152 B1 * 9/2004 Rooke et al. ..... 315/209 R

* cited by examiner

*Primary Examiner*—John Tweel, Jr.
(74) *Attorney, Agent, or Firm*—Waddey and Patterson, P.C.; Larry W. Brantley; Howard H. Bayless

(57) ABSTRACT

An LED light source drive includes an LED current generating circuit and an LED drive controller. The current generating circuit is operable to receive power from a power source and to generate a dc current that can be used to the drive an LED light source. The drive controller is operable to control the dc current to ensure that the light output of the light source remains approximately constant over its operating lifetime. In one embodiment, the drive controller ensures that the effective light output of the light source remains approximately constant by automatically increasing the dc current in predetermined amounts at predetermined times. In an alternative embodiment, the drive controller includes an LED light sensor that is operable to generate a light signal indicative of the effective light output of the light source and the controller uses this light signal to control the dc current output.

14 Claims, 4 Drawing Sheets

LED DRIVE FOR GENERATING CONSTANT LIGHT OUTPUT

BACKGROUND OF THE INVENTION

The present invention relates generally to devices that can be used to control the light output of light sources. More particularly, this invention pertains to a device that can be used to control the light output of a light emitting diode light source.

Light emitting diode (LED) light sources are known in the art. For example, the prior art teaches the use of LED traffic signal devices. These devices are typically designed to be connected to an ac power source and include an ac to dc converter that converts the ac power supplied to the device into dc power. This dc power is then used to power an array of LEDs included in the device.

The various benefits of LED based traffic devices are well known in the art. LED traffic devices consume less power than their incandescent traffic device counterparts. In addition, LED traffic devices have longer usable life spans when compared to their incandescent traffic device counterparts.

LED traffic devices, however, do have one specific disadvantage that is addressed by the present application. These devices generally include a plastic lens that is used to enclose the LEDs used in the LED traffic device. This lens degrades over time and, as a result, reduces the effective light output of these devices. This is an undesirable condition because it makes it difficult for automobile drivers to see the traffic signals generated by the LED traffic device.

A review of the prior art relating to LED traffic devices indicates that there does not appear to be any suitable solution to this problem.

What is needed, then, is some type of device that can be included with an LED traffic device that compensates for this reduction in effective light output and ensures that the effective light output of the LED traffic device remains relatively constant over the lifetime of the device.

SUMMARY OF THE INVENTION

Accordingly, one object of the present invention is to provide a device that can be used with an LED traffic device to compensate for the reduction of effective light output causes by degradation in the plastic lens used with this device.

Another object is to provide a device that can be used to compensate for the reduction in effective light output in LED light sources that may be caused by other reasons as well.

These objects, and other objects that will become apparent to one skilled in the art upon a review of this document, are satisfied by an LED drive that includes an LED current generating circuit and an LED drive controller. The LED current generating circuit is operable to receive power from a power supply and to generate a DC current based on that power input. The LED drive controller is operable to automatically increase the dc current output of the LED drive in predetermined amounts at predetermined times to ensure that the effective light output of an LED light source connected to the LED drive remains constant over the effective operating lifetime of the LED light source.

In one embodiment adapted to be connected to an ac power source, the LED drive includes an AC/DC converter, an inverter, a rectifier, and a microcontroller. The AC/DC converter is operable to convert a low frequency ac power signal applied to the device into a dc power signal and the inverter is operable to convert the dc power signal generated by the AC/DC converter into a high frequency ac power signal. The rectifier is operable to convert the high frequency ac power signal generated by the inverter into a dc power signal, which can then be applied to an LED light source and used to generate a dc current signal for the LED light source. The microcontroller is operable to automatically increase the dc power signal, and as a result, the dc current signal, applied to the LED light source in predetermined amounts at predetermined times to ensure that the effective light output of the LED array remains constant over the effective operating lifetime of the LED light source.

In a second embodiment adapted to be connected to a dc power source, the LED drive simply includes the inverter, rectifier, and microcontroller. The AC/DC converter is not necessary in this embodiment because the signal applied to the device is a dc signal rather than an ac signal.

In a third embodiment, adapted to be connected to an ac power source or a dc power source, the LED drive includes an LED light sensor that is operable to generate a light signal indicative of the effective light output of the LED light source. The LED drive controller in this embodiment is adapted to use the light signal to increase the dc current signal applied to the LED light source to ensure that the effective light output of the LED light source remains constant over the effective operating lifetime of the LED light source.

DESCRIPTION OF THE PREFERRED EMBODIMENTS

Figure 1:
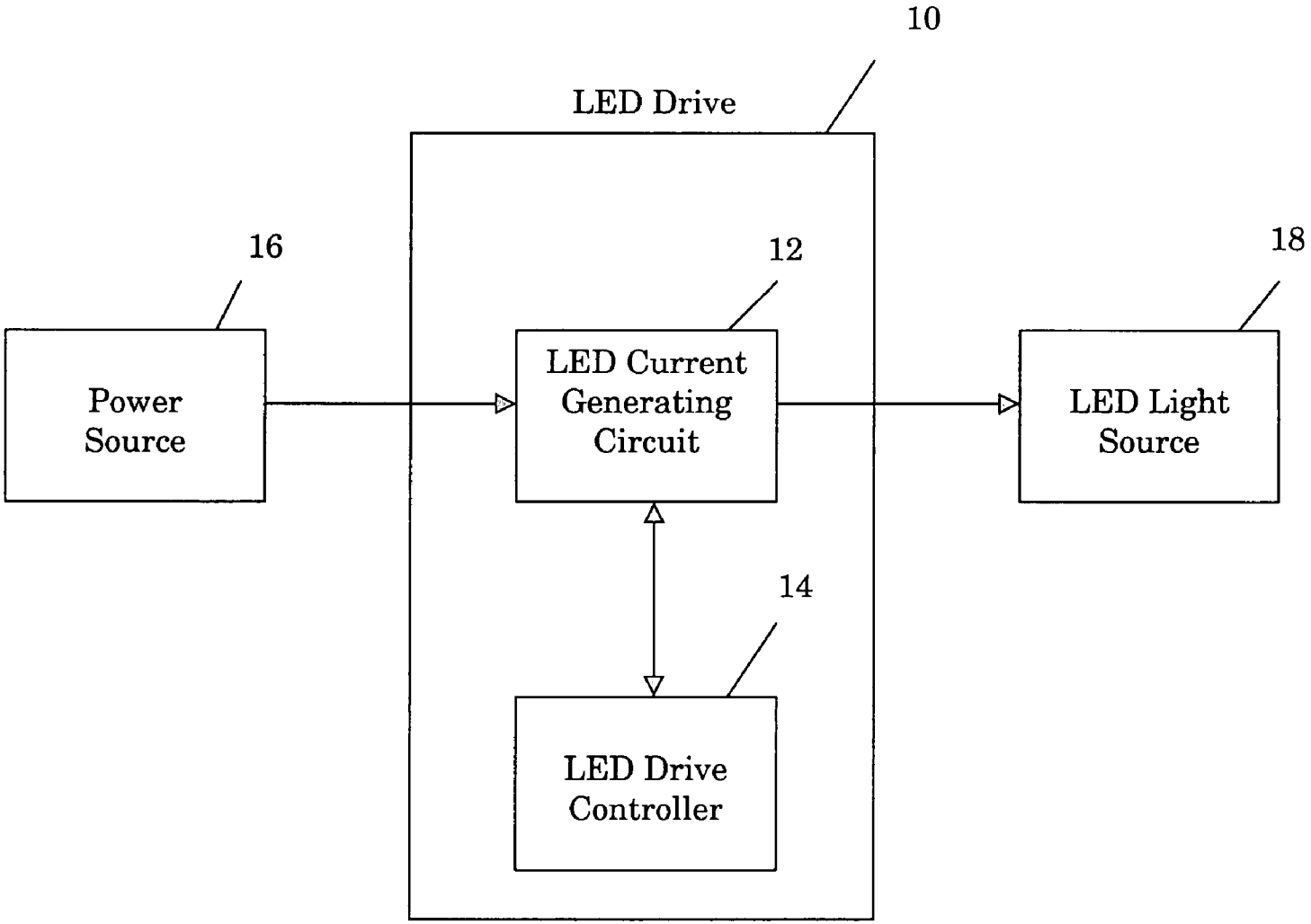
FIG. 1 is a block diagram showing one embodiment of the LED drive of the present invention.

Referring to FIG. 1, one embodiment of the light emitting diode (LED) light source drive 10 (referred to simply as the LED drive 10) of the present invention includes an LED current generating circuit 12 and an LED drive controller 14. The LED current generating circuit 12 may also be referred to as an LED voltage supply, an LED power converter, an LED current converter, or an LED current generator. In a similar manner, the LED drive controller 14 may alternatively be referred to as an LED voltage controller, an LED current controller, an LED power controller, or simply an LED controller.

The LED drive 10 is adapted to be connected to and to receive power from a power source 16 and to be connected to and output a current signal to an LED light source 18. More specifically, the LED current generating circuit 12 is adapted to receive power from the power source 16 and to convert that power into a power signal (also referred to as an output voltage signal) that can be applied to the LED light source 18. When the power signal is applied to the LED light source 18, a current signal is generated that drives the LED light source 18. The LED drive controller 14 is adapted to control the power signal and, as a result, the current signal, output by the LED current generating circuit 12 so that the effective light output of the LED light source 18 remains approximately constant over the effective operating lifetime of the LED light source 18, i.e., the time period during which the LED light source 18 is capable of outputting sufficient amounts of light so that the LED light source 18 can be used for its intended purpose. In other words, the LED drive controller compensates for reductions or degradations in the effective light output of the LED light source to ensure that the effective light output remains relatively constant over the operating lifetime of the LED light source 18. In one embodiment, the current signal supplied by the LED current generating circuit 12 is a dc current signal and the power signal generated by the LED current generating circuit 12 is a dc power signal.

The LED drive controller 14 of the present invention is designed to control the current signal output by the LED current generating circuit 12 in several different ways. In one embodiment (FIG. 2), which implements an open loop control scheme, the LED drive controller 14 is adapted to automatically increase the current signal output in predetermined amounts and at predetermined times during the effective operating lifetime of the LED light source 18. The amount and timing of the increase in the current signal is dependent upon the rate and timing of the degradation of the effective light output of the LED light source and varies from one application to another. In another embodiment (FIG. 4), which implements a closed loop control scheme, the LED drive controller 14 is adapted to increase the current signal output based on a light signal received from a feedback light sensor. Additional information regarding this embodiment is provided below. In still other embodiments, the LED drive controller 14 may be adapted to control the current signal using a combination of open loop and closed loop control schemes.

An LED light source typically includes some type of lens, in many cases a plastic lens, which degrades over the effective operating lifetime of the LED light source due to environmental conditions in the location where the LED light source is operated. In addition, other components used in the LED light source, e.g., LEDs, typically degrade over the effective operating lifetime of the LED light source due to wear caused by normal usage. This degradation causes the effective light output of the LED light source to decrease. The LED drive controller 14 is designed to compensate for this reduction in effective light output by increasing the current signal supplied to the LED light source. The amount of the increase in the current signal necessary to compensate for a reduction in effective light output is dependent upon the amount of the reduction in effective light output. In a similar manner, the timing of the increase in the current signal is dependent upon the timing of the reduction in effective light output.

The degradation in the effective light output of an LED light source may be constant or a variable depending on the type of LED light source and the environmental conditions in which it operates. If the rate is constant, the LED drive controller 14 can be adapted to increase the current signal output a certain percentage continually or at regular intervals. In addition, the LED drive controller 14 can be adapted to increase the current signal output at a constant or variable rate over the effective operating lifetime of the LED light source 18. For example, if the effective light output of an LED light source degrades 10% every 1000 hours of operating time, the LED drive controller 14 can be adapted to increase the current signal output by 10%, or whatever amount is necessary to ensure that the effective light output stays approximately constant in spite of the degradation, after every 1000 hours of operating time. If, on the other hand, the effective light output degrades 10% after the first 1000 hours of operating time and 15% for every 1000 hours of operating time thereafter, the LED drive controller 14 can be adapted to increase the current signal output by 10% after the first 1000 hours of operation and 15% for every 1000 hours of operating time thereafter. In other embodiments, LED light sources may experience any one of a variety of degradation profiles, i.e., constant degradation, variable degradation, or a combination of constant and variable degradation, and the LED drive controller 14 can be adapted to compensate for these degradation profiles.

Figure 2:
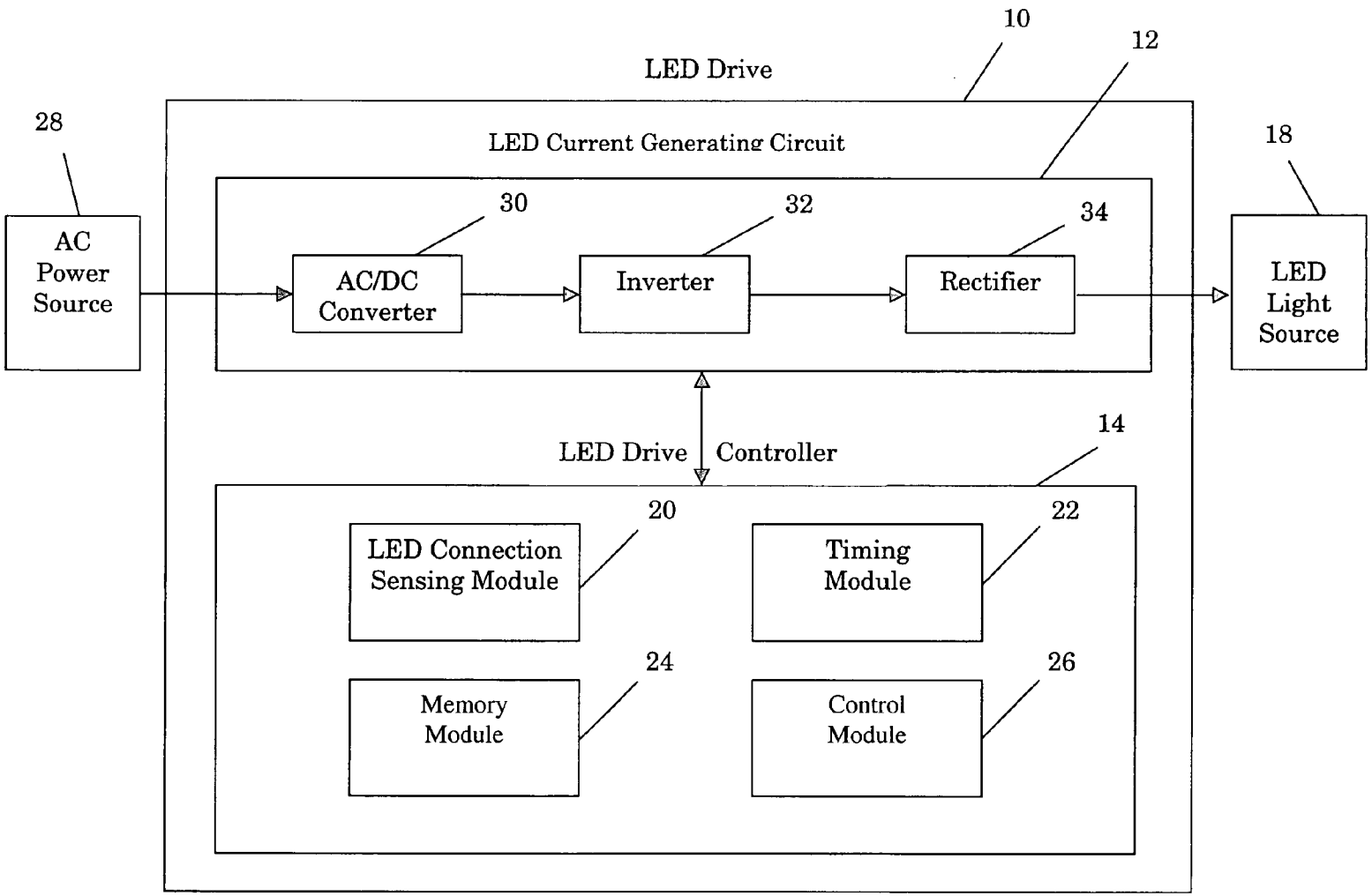
FIG. 2 is a block diagram showing an embodiment of the LED drive of the present invention adapted to be connected to an ac power source.

To enable the LED drive controller 14 to automatically increase the current signal supplied to the LED light source 18 by the LED current generating circuit 14 in predetermined amounts and at predetermined times, the LED drive controller 14 includes an LED connection sensing module 20, a timing module 22, a memory module 24, and a control module 26 (see FIG. 2). The LED connection-sensing module 20 is adapted to sense when the LED light source 18 is connected or disconnected from the LED drive 10 and to generate a connection signal indicative of that fact. The timing module 22 is adapted to generate a timing signal indicative of the operating time of the timing module 22. The memory module 24 is adapted to store information regarding the effective operating lifetime of the LED light source 18 and information regarding when the LED drive controller 14 should increase the current signal output to the LED light source 18 and the amount of that increase. The control module 26 is adapted to control the overall operation of the LED drive 10 as described below.

In operation, the LED connection sensing module 20 senses when the LED light source 18 is connected to the LED drive 10 and sends the connection signal indicative of that fact to the control module 26. In response to this connection signal, the control module 26 in the LED drive controller 14 activates the timing module 22, which generates the timing signal indicative of the operating time of the timing module 22. The operating time of the timing module 22 is assumed to be the operating time of the LED light source 18 because the timing module 22 is activated when the LED light source 18 is connected to the LED drive 10. The control module 26 in the LED drive controller 14 monitors the timing signal and compares it to the information stored in the memory module 24 to determine when it should increase the current signal output by the LED current generating circuit 12. When the comparison of the timing signal and the information stored in the memory module 24 indicates that the current signal should be increased, the control module 26 uses the information stored in the memory module 24 to determine the amount of that increase and then causes the LED current generating circuit 12 to increase the current signal in the appropriate amount.

The LED connection-sensing module 20 can be implemented in a variety of different ways well known in the art. For example, in one embodiment, the LED connection-sensing module 20 is simply a resistor having a very low resistance. In this case, if the LED light source 18 is connected to the LED drive 10 and the LED drive 10 is supplying the current signal to the LED light source 18, a voltage is developed across the resistor. If the LED light source 18 is disconnected from the LED drive 10, the voltage across the resistor will drop to zero because no current can flow through the resistor when the LED light source 18 is disconnected. The control module 26 in the LED drive controller 14 monitors the voltage on the resistor to determine when the LED light source 18 is connected to the LED drive 10 and activates the timing module 22 based on that voltage.

The LED drive controller 14 may also include a variety of additional features designed to make the LED drive 10 safer and easier to operate. The LED drive controller 14 may be adapted to automatically stop increasing the current signal output by the LED current generating circuit 12 or to stop outputting the current signal completely when the effective operating lifetime of the LED light source 18 is reached. The LED drive controller 14 may also be adapted to automatically cause the LED current generating circuit 12 to stop supplying the current signal to the LED light source 18 when the LED drive controller 14 senses that the LED light source 18 has been disconnected and to automatically restart when the LED light source 18 has been reconnected. The LED drive controller 12 may further be adapted to automatically reset the timing module 22, which is used by the control module 26 in the LED drive controller 12 to calculate the amount of time that the LED light source 18 has been operating and discussed in detail above, when the LED light source 18 is replaced and the LED current generating circuit 14 is supplying current to the LED light source 18.

To enable the LED drive controller 14 to automatically stop supplying the current signal to the LED light source 18 when the LED light source 18 is disconnected from the LED drive 10 and to automatically restart when the LED light source 18 is reconnected to the LED drive 10, the control module 26 in the LED drive controller 14 monitors the connection signal generated by the LED connection sensing module 20 and, when that signal indicates that the LED light source has been disconnected, the control module 26 causes the LED current generating circuit 12 to stop supplying the current signal to the LED light source 18. In a similar manner, if the connection signal indicates that the LED light source 18 has been reconnected to the LED drive 10, the control module 26 causes the LED current generating circuit 12 to start supplying the current signal to the LED light source 18 again.

The LED connection-sensing module 20 is also used by the control module 26 to automatically reset the timing module 22 when the LED light source 18 is replaced and the LED current generating circuit 14 is supplying current to the LED light source 18. As indicated above, the LED connection sensing module 20 generates the connection signal indicative of whether or not the LED light source 18 is connected to the LED drive 10. When this signal indicates that the LED light source 18 is disconnected from the LED drive 10, the control module 26 automatically resets the timing module 22. If power is not being supplied to the LED drive 10, i.e., the LED drive 10 is not "on," the control module 26 will not reset the timing module 22 when the LED light source 18 is disconnected from the LED drive 10.

To enable the LED drive controller 14 to automatically stop increasing the current signal supplied to the LED light source 18 or to automatically stop supplying the current signal to the LED light source 18 completely when the LED light source 18 reaches the end of its effective operating lifetime, the control module 26 takes the timing signal generated by the timing module 22 and compares it to information stored in the memory module 24 to determine when the effective operating lifetime of the LED light source 18 has been reached. When the comparison of the timing signal and the information stored in the memory module 24 indicates that the effective lifetime has been reached, the control module 26 causes the LED current generating circuit 12 to stop increasing the current signal to the LED light source 18. Alternatively, the control module 26 causes the LED current generating circuit 12 to stop supplying the current signal to the LED light source 18 completely.

One skilled in the art will recognize that the various modules used in the LED drive controller 14 may be implemented using hardware, software, or a combination of hardware and software. The description of the LED drive controller 14 included above is not meant to limit the LED drive controller 14 of the present invention to the specific embodiment described above. The applicant contemplates that the LED drive controller 14 may be implemented in a variety of different ways using hardware and/or software combinations limited only by the ingenuity of one skilled in the art.

The power source 16 may be an ac power source or a dc power source depending upon the application. In a similar manner, the LED light source 18 may be any one of a variety of different LED light sources known in the art. For example, in one embodiment, the LED drive 10 of the present invention is adapted to be used with an LED traffic signal device well known in the art. In other applications, the LED drive 10 is adapted to be used with other types of LED light sources as well.

The LED current generating circuit 12 varies depending upon the type of power source 16 that is to be used. Referring to FIG. 2, in one embodiment, the LED drive 10 is adapted to be used with an ac power source 28. In this embodiment, the LED current generating circuit 12 includes an AC/DC converter 30, an inverter 32, and a rectifier 34. The AC/DC converter 30 is adapted to convert a low frequency ac power signal, e.g., typically 120 volts at 60 Hz, to a dc power signal and to provide that signal to the inverter 32. The inverter 32 is adapted to convert the dc power signal into a high frequency ac power signal, typically 25–60 kHz, and to provide that signal to the rectifier 34. The rectifier 34, in turn, is adapted to convert the high frequency ac power signal into the dc current signal used to supply power to the LED light source 18. The LED drive controller 14 varies the dc current signal output by the LED current generating circuit 12 by varying the frequency of the inverter 32 as is well known in the art.

In one embodiment, the inverter 32 is a half-bridge inverter (not shown) that includes a series resonant output circuit (not shown). The operation of half-bridge inverters having series resonant output circuits is well known in the art and will not be discussed in detail in this application. It is sufficient to point out that these types of inverters are adapted to receive a dc power signal input and to convert that signal into a high frequency ac power signal. More specifically, the half-bridge portion of the inverter converts the dc power signal input into a high frequency pulsed dc power signal and the series resonant output circuit converts the high frequency pulsed dc power signal into a high frequency ac power signal. In addition, it is important to note that the current output of these types of inverters can be increased or decreased by varying the output frequency of the half-bridge portion of the inverter. In other embodiments, other types of inverters capable of generating a high frequency ac power signal output may be used as well.

The rectifier circuit 34 is a full bridge rectifier (not shown) that includes a smoothing output capacitor (not shown). As was the case with the inverter 32 discussed above, full bridge rectifiers are well known in the art and a detailed description is not necessary for an understanding of the present invention. It is sufficient in this case to point out that the full bridge rectifier is adapted to convert the high frequency ac power signal input into a dc power signal and the smoothing output capacitor is adapted to smooth the output of the full bridge rectifier so that the dc power signal is approximately constant. The dc power signal can then be used to supply the dc current signal to the LED light source 18. In alternative embodiments, the rectifier 34 may be a bridge rectifier, as opposed to a full-bridge rectifier, i.e., it includes only two diodes rather than the four diodes required for the full bridge rectifier, or a single diode rectifier.

The AC/DC converter 30 required by the LED drive 10 of the present invention is also a full-bridge rectifier (not shown) that includes a smoothing output capacitor (not shown) and operates in a manner that is similar to that of the rectifier 34 as described above.

Figure 3:
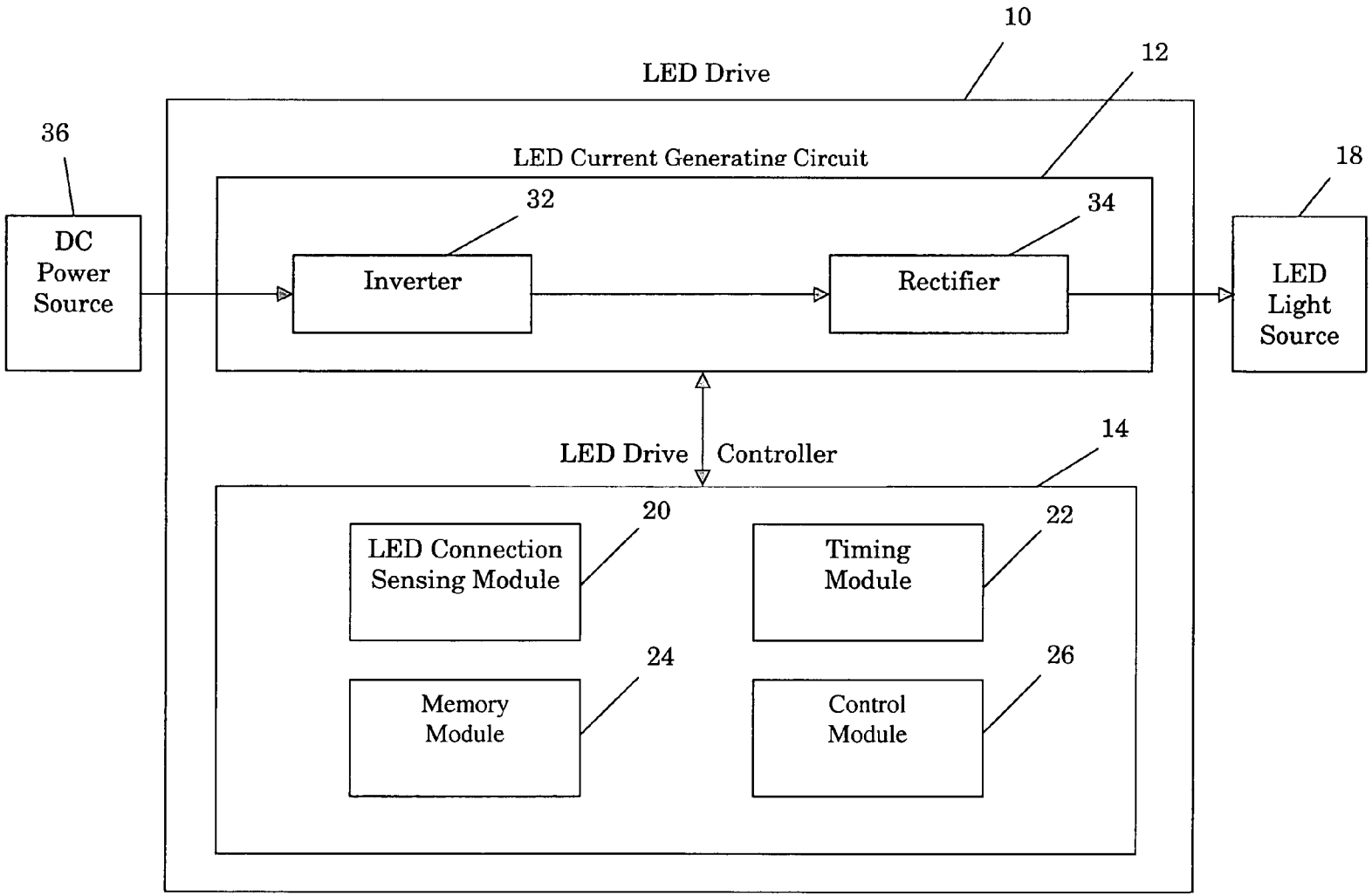
FIG. 3 is a block diagram showing an embodiment of the LED drive of the present invention adapted to be connected to a dc power source.

Referring to FIG. 3, another embodiment of the present invention is shown. In this embodiment, the LED drive 10 is adapted to be connected to a dc power source 36 and to receive a dc power signal input. In this case, the AC/DC converter 30 is not required because the input signal is a dc power signal rather than an ac power signal as shown in FIG. 2. With the exception of the conversion of an ac power signal into a dc power signal, the LED drive 10 shown in FIG. 3 operates in a manner identical to that described above for LED drive 10 shown in FIG. 2.

Figure 4:
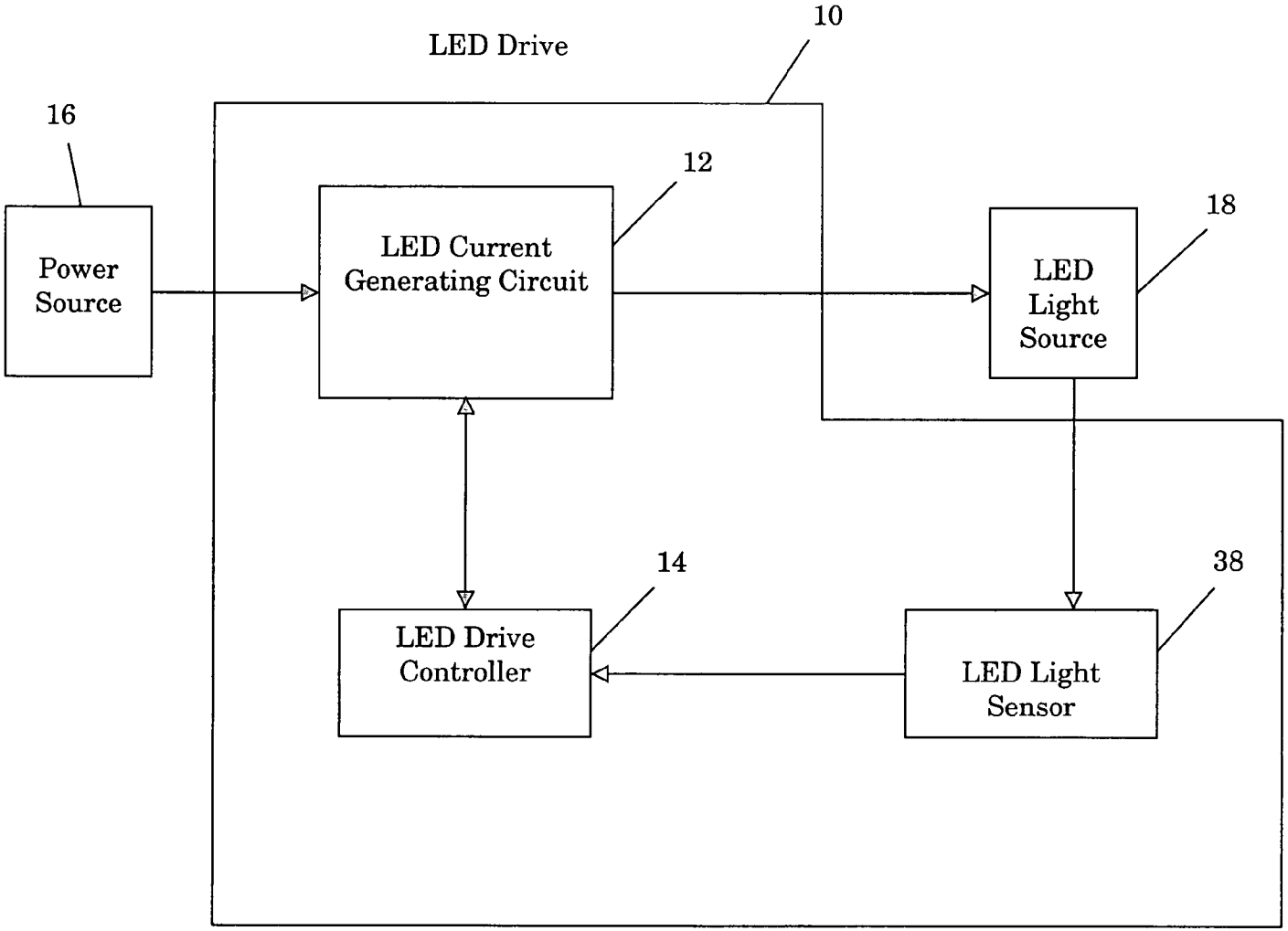
FIG. 4 is a block diagram showing an embodiment of the LED drive of the present invention that includes an LED light sensor.

Turning now to FIG. 4, an additional embodiment of the LED drive 10 of the present invention is shown. This embodiment includes a LED light sensor 38 that is adapted to generate a light signal indicative of the effective light output of the LED light source 18. The light signal is fed back to the LED drive controller 14 and the control module 26 included in the LED drive controller 14 uses the light signal to vary the current signal output by the LED current generating circuit 12. More specifically, the control module 26 compares the light signal to information stored in the memory module 24 and, when the comparison indicates that the effective light output of the LED light source has dropped below a certain predetermined level, e.g., 10% of the desired effective light output, the control module 26 causes the LED current generating circuit 12 to increase the current signal supplied to the LED light source. Note that LED drive controller 14 may or may not be adapted to automatically increase the current signal in predetermined amounts at predetermined times in this embodiment. The applicant contemplates that the LED light sensor 38 may be used to complement the automatic operation of the LED drive controller 14 described in previous embodiments or to replace that operation altogether.

Thus, although there have been described particular embodiments of the present invention of a new and useful LED Drive For Generating Constant Light Output, it is not intended that such references be construed as limitations upon the scope of this invention except as set forth in the following claims.

What is claimed is:

1. A power supply for a light emitting diode (LED) light source, comprising:

an LED power converter adapted to receive power from a power source and to generate an output power signal that can be applied to an LED light source having an effective operating lifetime and an effective light output; and an LED power controller connected to the LED power converter and adapted to control the output power signal so that it compensates for degradations in the effective light output of the LED light source and ensures that light output by the LED light source when it is connected to the LED power converter remains relatively constant over the effective operating lifetime of the LED light source, wherein the LED power converter is further adapted to:

receive a low frequency ac power signal;

convert the low frequency ac power signal into a dc power signal;

convert the dc power signal into a high frequency ac power signal; and convert the high frequency ac power signal into the output power signal.

2. The power supply of claim 1, wherein the LED power controller is adapted to increase the output power signal by:

measuring an amount of time that the LED drive is connected to the LED light source;

comparing the measured time to a reference time; and when the measured time exceeds the reference time, increasing the output power signal a predetermined percentage.

3. The power supply of claim 2, wherein the LED power controller is adapted to measure the amount of time that the LED drive is connected to the LED light source by:

sensing when the LED light source is connected to the LED drive; and activating a timing module when the controller senses that the LED light source has been connected to the LED drive.

4. The power supply of claim 3, wherein the LED power controller is adapted to reset the timing module when the LED light source is replaced while the power source is supplying power to the LED drive.

5. A light emitting diode (LED) light source control system, comprising:

an LED current converter adapted to receive current from a current source and to generate a current signal that can be supplied to an LED light source having an effective operating lifetime and an effective light output, wherein the LED current converter is further adapted to generate a high frequency ac power signal and to convert the high frequency ac power signal into the current signal;

an LED light sensor adapted to receive light output by the LED light source and to generate a light signal based on the light output; and an LED controller connected to the LED current converter and the LED light sensor, the LED controller adapted to adjust the current signal output by the LED power converter based on the light signal so that the current signal compensates for degradations in the effective light output of the LED light source and maintains the light output by the LED light source at a relatively constant level over the effective operating lifetime of the LED light source, wherein the LED controller further adapted to increase the current signal by increasing the frequency of the high frequency ac power signal.

6. The control system of claim 5, wherein the LED controller is adapted to stop increasing the current signal output by the LED current converter when the effective operating lifetime of the LED light source is exceeded.

7. The control system of claim 5, wherein the LED controller is adapted to stop supplying the current signal to the LED light source when the effective operating lifetime of the LED light source is exceeded.

8. The control system of claim 5, wherein the LED current converter has a nominal output current signal; and the LED controller is adapted to increase the current signal output to the LED light source a predetermined percentage of the nominal output current signal after LED light source has been operated for a predetermined number of hours.

9. The control system of claim 5, wherein the LED controller is adapted to cause the LED current converter to stop outputting the current signal when the LED light source is disconnected from the LED drive.

10. The control system of claim 5, wherein the LED controller is adapted to cause the LED current converter to:

stop outputting the current signal when the LED light source is disconnected from the LED drive; and to automatically restart outputting the current signal when the LED light source is reconnected to the LED drive.

11. A power supply for a light emitting diode (LED) light source, comprising:

an LED power converter adapted to receive power from a power source and to generate an output power signal that can be applied to an LED light source having an effective operating lifetime and an effective light output; and an LED power controller connected to the LED power converter and adapted to control the output power signal so that it compensates for degradations in the effective light output of the LED light source and ensures that light output by the LED light source when it is connected to the LED power converter remains relatively constant over the effective operating lifetime of the LED light source, wherein the LED power converter is further adapted to:

receive a dc power signal;

convert the dc power signal into a high frequency ac power signal; and convert the high frequency ac power signal into the output power signal.

12. The power supply of claim 11, wherein the LED power controller is adapted to increase the output power signal by:

measuring an amount of time that the LED drive is connected to the LED light source;

comparing the measured time to a reference time; and when the measured time exceeds the reference time, increasing the output power signal a predetermined percentage.

13. The power supply of claim 12, wherein the LED power controller is adapted to measure the amount of time that the LED drive is connected to the LED light source by:

sensing when the LED light source is connected to the LED drive; and activating a timing module when the controller senses that the LED light source has been connected to the LED drive.

14. The power supply of claim 13, wherein the LED power controller is adapted to reset the timing module when the LED light source is replaced while the power source is supplying power to the LED drive.

* * * * *